United States Patent [19]

Donnerstag et al.

[11] Patent Number: 4,483,285

[45] Date of Patent: Nov. 20, 1984

[54] DIESEL ENGINE COLD STARTING ARRANGEMENT

[75] Inventors: Hans Donnerstag; Werner Donnerstag, both of Gross-Rohrheim, Fed. Rep. of Germany

[73] Assignee: Deere & Company, Moline, Ill.

[21] Appl. No.: 471,087

[22] Filed: Mar. 1, 1983

[30] Foreign Application Priority Data

Mar. 8, 1982 [EP] Eurpoean Pat. Off. ..... 82301178.8

[51] Int. Cl.[3] ..... F02N 17/02

[52] U.S. Cl. ..... 123/179 H; 123/514; 123/550

[58] Field of Search ..... 123/179 H, 187.5 R, 123/187.5 P, 551, 550, 142.5 R, 514

[56] References Cited

U.S. PATENT DOCUMENTS

| | | | |
|---|---|---|---|
| 1,025,814 | 5/1912 | Lemp | 123/514 |
| 1,314,056 | 8/1919 | Good | 123/187.5 R |
| 3,379,184 | 4/1968 | Wolf | 123/179 H |
| 3,485,226 | 12/1969 | Arendt et al. | 123/179 H |

FOREIGN PATENT DOCUMENTS

| | | | |
|---|---|---|---|
| 2030214 | 4/1980 | United Kingdom | 123/179 H |

*Primary Examiner*—Andrew M. Dolinar

[57] ABSTRACT

A return line communicates excess fuel from the injectors of a diesel engine to a fuel tank and is connected to a nipple on a filler pipe of the fuel tank. A dam wall is provided inside the pipe over an inlet from the nipple and forms a small reservoir for fuel which can be fed via a T-connection and branch line to a known nozzle and ignition system which burns fuel in the intake manifold to facilitate cold starting.

2 Claims, 1 Drawing Figure

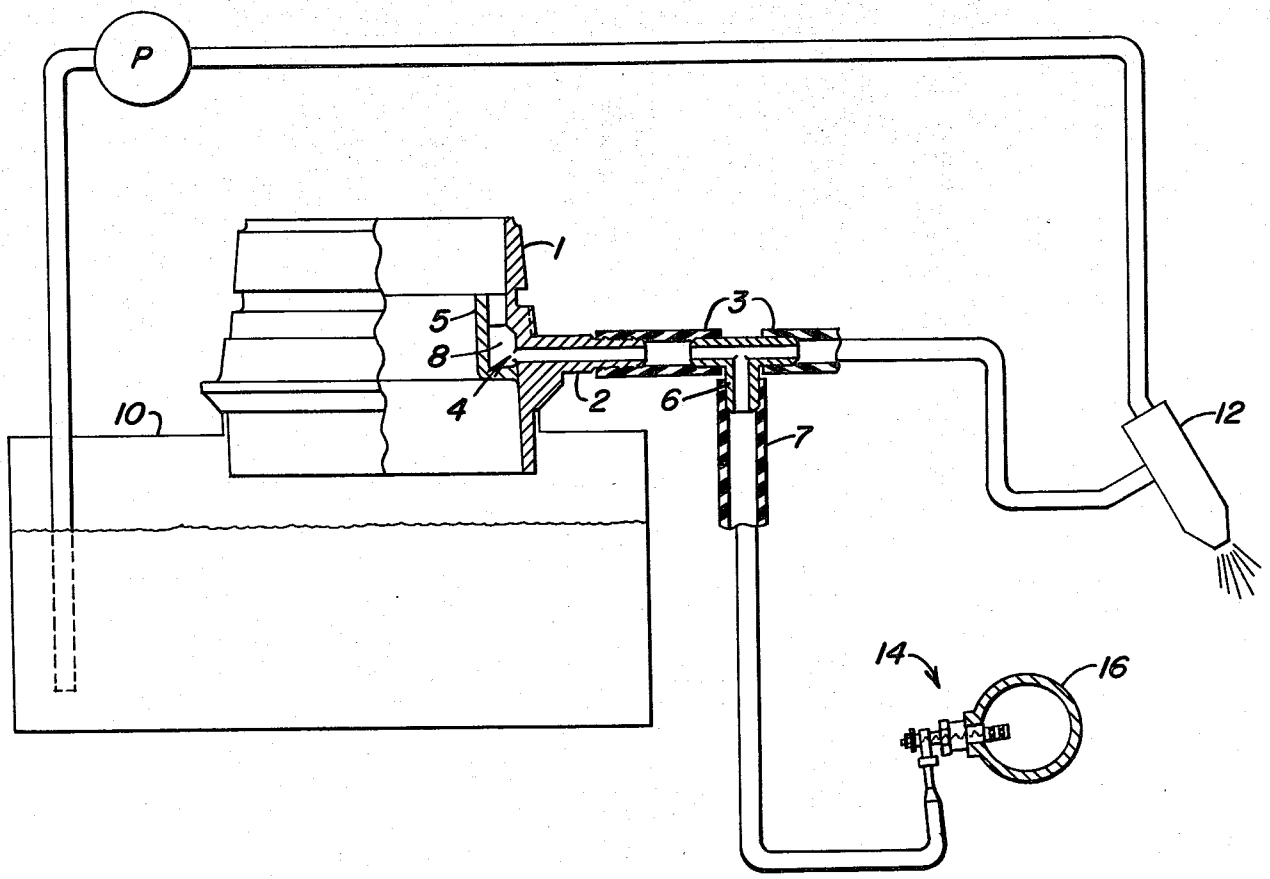
12
16
14
7
3
6
2
1
5
8
4
10
P

DIESEL ENGINE COLD STARTING ARRANGEMENT

BACKGROUND OF THE INVENTION

The present invention relates to a diesel engine cold starting system with means for burning a predetermined small quantity of fuel drawn from a reservoir therefor.

Such systems are employed in some commercially available agricultural tractors. In certain of these systems, the means for burning comprises an electrically controlled nozzle and ignition system whereby the fuel is introduced into the intake manifold and burned there. The heat thus generated makes it possible then to start the engine even in extremely cold weather. The risks in burning fuel in this way are evident, and for this reason, it is necessary to supply only a predetermined small quantity of fuel for this purpose. This is achieved by providing a special small reservoir which contains only the required small quantity of fuel. Fuel for the burning means is then only from this special reservoir, not directly from the tank.

The special reservoir represents an additional manufacturing expense both as to the cost of the reservoir itself and as to the mounting thereof. Moreover, the larger the number of elements in the fuel system, the greater the risk of leaks, which are a maintainence problem and which can even give a risk of fire.

SUMMARY OF THE INVENTION

Accordingly, an object of this invention is to provide a cold start system which is both simpler and safer than the known system wherein a reservoir is formed by a fuel return system which returns excess fuel to the tank from the injectors of the engine.

This and other objects are achieved by providing a dam over which the fuel return line feeds into the tank, e.g. by welding or brazing a wall to the side of the filler pipe of the tank. The dam holds back a certain quantity of fuel for the cold-start burning. A T-connection in the return line supplies fuel to the burning means. The dam does not require separate assembly and sealing. The dam is in the tank and cannot give rise to any fuel leak.

BRIEF DESCRIPTION OF THE DRAWING

The sole FIGURE is a partial sectional view of the present invention.

DETAILED DESCRIPTION

The FIGURE shows the filler pipe 1 of the fuel tank 10 of a tractor with a nipple 2 onto which is fitted the return line 3 of a conventional return system, whereby excess fuel is returned from the injectors 12 of the diesel engine to the tank.

Inside the filler pipe 1, over the inlet 4 from the nipple 2, there is welded or brazed a dam wall 5. Alternatively, if the tank or at least the filler pipe 1 is of plastics material, the wall 5 can be molded integrally therewith. A T-connection 6 is connected into the return line 3 to connect to a branch line 7 which leads to the known nozzle and ignition system or burning means 14 for burning fuel in the intake manifold 16.

In normal running, excess fuel is constantly returned from the injectors through the line 3 and flows over the dam 5, back into the tank. When the engine is turned off, a small quantity of fuel 8 is retained by the dam. If it is necessary to use the cold starting arrangement when next starting the engine, the nozzle and ignition system draws just that fuel 8 retained by the dam, plus some fuel in the lines 3 and 7 for burning in the manifold. Thus, only a predetermined small quantity of fuel is available for this purpose and there is virtually no risk of an engine fire. It is nevertheless possible to repeat the cold starting cycle because the dam retains enough fuel for two cold starts. Moreover, the reservoir 8 is replenished when the engine is cranked, even if it does not start.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

We claim:

1. In a diesel engine cold starting system having a fuel injector, a main fuel tank, a return line for returning fuel from the injector to the main tank via a return inlet, a reservoir for storing a quantity of cold start fuel, burning means for burning fuel in an intake manifold of the engine and a branch line for communicating fuel from the reservoir to the burning means, the improvement wherein:

the reservoir is formed by a wall which forms a dam around the return inlet so that a quantity of fuel for cold starting trapped by the dam flows to the burning means via a portion of the return line and via the branch line.

2. The invention of claim 1, wherein:

the main tank receives fuel via a filler pipe, the return inlet being located in the filler pipe, and the dam wall is located on the inside of the filler pipe.

* * * * *